United States Patent [19]

Smeets

[11] 4,280,968

[45] Jul. 28, 1981

[54] GAS CARBURETTOR TO BE MOUNTED ON A PETROL CARBURETTOR OF A COMBUSTION ENGINE

[76] Inventor: Andreas L. M. T. Smeets, Orleanshof 11, Eindhoven, Netherlands

[21] Appl. No.: 108,506

[22] Filed: Dec. 31, 1979

[51] Int. Cl.[3] ..... F02M 13/08

[52] U.S. Cl. ..... 261/16; 123/525; 48/180 C; 261/DIG. 67

[58] Field of Search ..... 261/16, DIG. 67, DIG. 56; 48/180 C; 123/525

[56] References Cited

U.S. PATENT DOCUMENTS

| | | | |
|---|---|---|---|
| 1,802,019 | 4/1931 | Howson | 48/180 C |
| 1,890,058 | 12/1932 | Holzapfel | 261/16 |
| 1,931,698 | 10/1933 | Holzapfel | 261/16 |
| 2,228,171 | 1/1941 | Lutherer et al. | 48/180 C |
| 2,349,676 | 5/1944 | Pratt | 261/16 |
| 2,572,338 | 10/1951 | Hartwig et al. | 48/180 C |
| 2,645,570 | 7/1953 | Anderson | 261/16 |
| 2,726,073 | 12/1955 | Seld | 261/DIG. 56 |
| 2,731,251 | 1/1956 | Lunn | 261/DIG. 67 |
| 3,336,734 | 8/1967 | Schultz | 261/96 |
| 4,119,068 | 10/1978 | Csonka et al. | 261/DIG. 56 |

*Primary Examiner*—Tim R. Miles

[57] ABSTRACT

A gas carburettor suitable for mounting on a petrol carburettor of a combustion engine and intended for mixing a gas with air and for supplying the mixture of air and gas to the combustion engine. The gas carburettor comprises a housing having a centrally arranged passage bounded by a wall of the housing. The wall bounding the passage has an opening therethrough for supplying gas to the passage. A member is disposed in the passage such that an annular airway is defined between the housing and the member.

7 Claims, 5 Drawing Figures

GAS CARBURETTOR TO BE MOUNTED ON A PETROL CARBURETTOR OF A COMBUSTION ENGINE

The invention releates to a gas carburettor suitable for mounting on a petrol carburettor of a combustion engine intended for mixing gas with air and for supplying the mixture of air and gas to the combustion engine, said gas carburettor comprising a housing having a centrally arranged passage bounded by a wall of the housing, said wall bounding the passage having an opening for the supply of gas in the passage.

It is known to construct, in particular, engines for automobiles and the like in a manner such that they can run both on petrol and gas (the so-called LPG), which is stored in the liquid state in a tank of the vehicle and is gassified with the aid of one or more evaporators for supply to the gas carburettor. In order to obtain a simple mounting it is usually preferred to arrange the gas carburettor on top of the petrol carburettor.

A problem is involved in petrol engines in which the petrol carburettor has a comparatively large passage for passing combustion air to the combustion engine, e.g. in engines of comperatively high power, and wherein the flow of air is controlled in known manner with the aid of one or more chokes.

When, as hitherto has been common practice to do, a gas carburettor having a passage equal to the passage of the petrol carburettor is mounted on such a petrol carburettor, it appears that the air flow through the gas carburettor slows and so the sub-atmospheric pressure is to low for sucking an adequate amount of gas for acquiring a correct working of the engine.

The invention has for its object to provide a gas carburettor which can be employed in conjunction with a petrol carburettor whilst the difficulties described above are avoided, so that even petrol engines having comparatively high power can be equipped, apart from the petrol carburettor, with a gas carburettor as a result of which the engine can run both on gas and petrol with a correct mixture ratio for producing the required power.

According to the invention this can be achieved by disposing in the passage a member partly closing the passage in a manner so that for passing air only an annular gap is available along the wall of the housing bounding the passage.

In practice it has been found that in this way a gas carburettor can be obtained in which the velocity of air in the annular gap is sufficiently high for sucking the desired amount of gas during operation, whereas otherwise the passage for the air to the gas carburettor is sufficiently large for ensuring an effective operation of the petrol carburettor located beneath the gas carburettor.

The invention will be described more fully hereinafter with reference of one embodiment of the construction in accordance with the invention shown schematically in the accompanying drawings.

Figure 1:
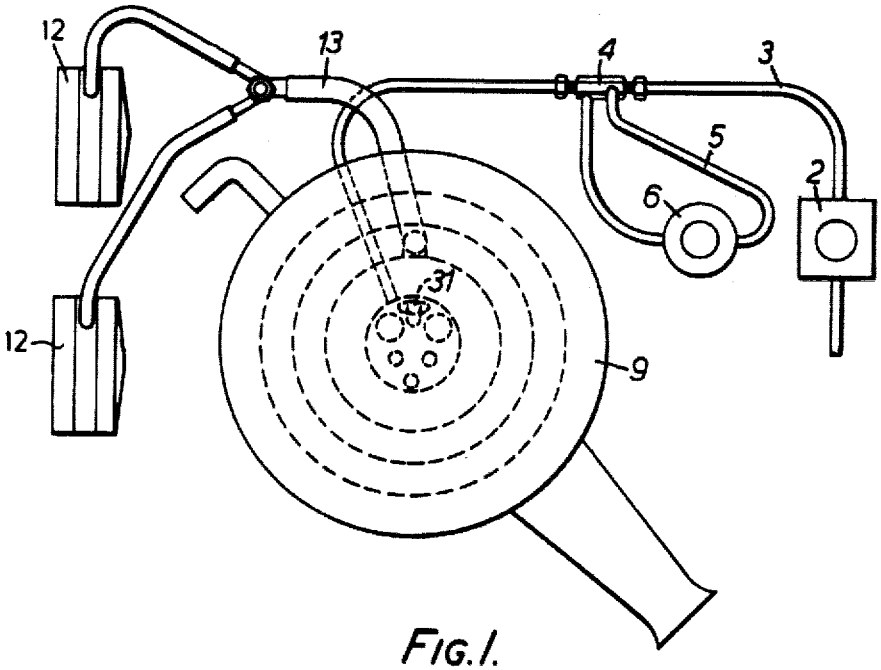
FIG. 1 is a schematic plan view of an assembly of carburettors evaporators and the like in accordance with the invention.
Figure 2:
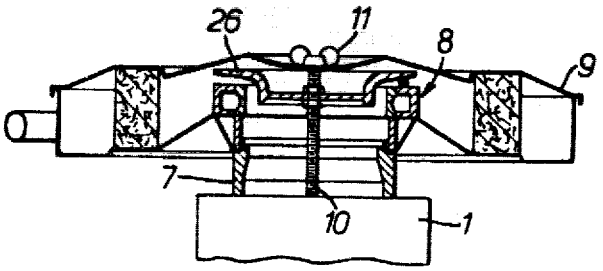
FIG. 2 is a schematic sectional view of a gas carburettor with an air filter mounted on the top end of a petrol carburettor.

As is shown schematically in FIG. 2, a petrol engine is provided in a conventional manner with a petrol carburettor 1, to which can be supplied petrol in a manner known per se with the aid of a petrol pump 2 (FIG. 1) through a feeding duct 3.

In order to render the combustion engine suitable for feeding both on petrol and gas (LPG), the feeding duct 3 is provided with a coupling member 4, with which communicates a shunt duct 5 in a manner such that from the pump 2 to the carburettor 1 the petrol can flow only through the shunt duct 5. This shunt duct 5 includes a preferably electrically controllable valve 6, by which the passage through the shunt duct 5 can be optionally opened or closed.

A gas carburettor 8 to be described more fully hereinbelow is disposed for the adaptation on the top end 7 of the petrol carburettor, where conventionally the air filter is connected, said gas carburettor together with the air filter 9 being fixed to the petrol carburettor with the aid of a central bolt 10 and a wing nut 11 or the like screwed onto the top end thereof. In operation the liquefied gas from a separate tank (now shown) is supplied through ducts (not shown) to one ore more evaporation units 12, which communicate through ducts with a gas feeding duct 13 connected with the gas carburettor 8.

Figure 3:
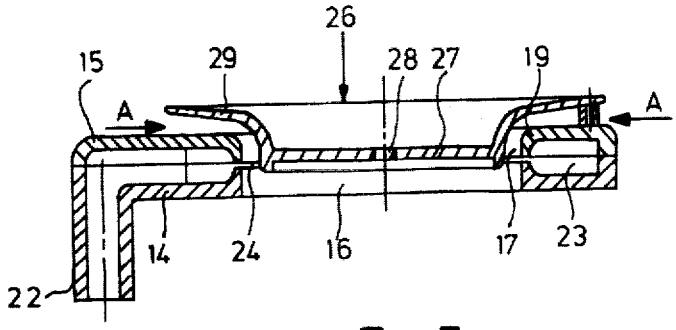
FIG. 3 is an enlarged cross-sectional view of the gas carburettor.

From FIG. 3, in particular, it will be apparent that the gas carburettor comprises an at least substantially annular housing composed two parts 14 and 15, said housing bounding a central, circular-section passage 16.

Figure 4:
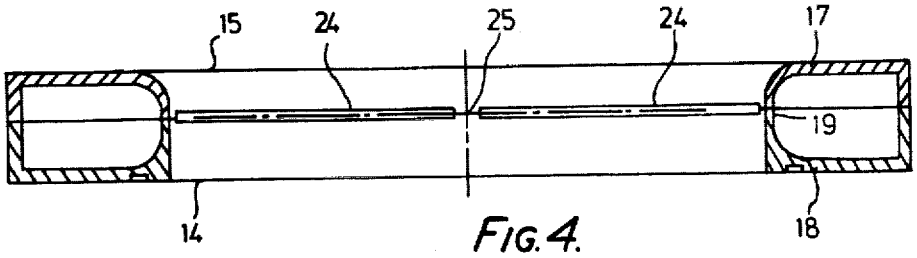
FIG. 4 is a further enlarged cross-sectional view of the housing of the gas carburettor shown in FIG. 3.

FIG. 4 in particular shows the housing 14, 15 defines an uninterrupted channel 23 around the central passage 16. The channel 23 is seen in cross section substantially rectangular with two rounded corners. A connecting nipple 22 for the feeding duct 13 is also formed by the parts 14 and 15.

FIG. 4 furthermore shows in particular that the channel 23 is in open communication with the passage 16 through four elongated openings or slots 24 in the inner wall 19 of the annular carburettor housing, said slots 24 being separated from one another in various points by short dams 25 so that the elongated slots 24 extending concentrically about the centre line of the passage 16 and cover substantially the whole circumference of the inner wall of the gas carburettor housing.

In the passage 16 is arranged a closing member 26, which comprises a wall 27 being at right angles to the centre line of the passage 16 and having a hole 28 for passing the fastening bolt 10. The outer periphery of the wall 27 formed by a round plate is joined by a wall portion 29 extending upwards and flaring outwards from an end located at a short distance below the plate 27, whilst the part of said wall portion 29 located directly above the plate 27 extends substantially parallel to the inner wall 19 of the housing 14, 15 of the inner. The part of the wall portion 29 extending above the upper wall of the housing 14, 15 is disposed so that the distance between said upper wall and the wall portion 29 gradually increases to the outside. In this way an annular gap 19 is formed between the housing 14, 15 of the gas carburettor 8 and the closing member 26. When the gas carburettor is arranged on an engine in the manner described above, the air sucked in during the operation of the engine will flow through the annular gap 17 in the direction indicated by the arrow A and since the size of the passage of the annular gap 17, viewed in the direction of the arrow A, gradually decreases, the velocity of the air will increase. As a result the air will flow with high velocity along the slots 24 and carry on by suction the gas from the channel 23 so that an effective operation of the gas carburettor is ensured. The passage for air formed by the annular gap will furthermore have a sufficiently large surface for ensuring as well effective operation of the petrol carburettor 1 located beneath the gas carburettor so that by using the construction in accordance with the invention a combination of the petrol carburettor and the gas carburettor can also be employed without any objection for engines of comparatively high power.

Figure 5:
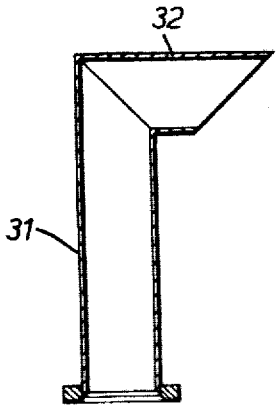
FIG. 5 is a sectional view of a venting pipe disposed in the petrol carburettor for the float chamber.

Usually the petrol carburettor has one or more vent tubes 31 for the float chamber of the petrol carburettor. Normally such a vent tube is open at the top, but as a result of the air stream produced by the gas carburettor, which stream differs from the normal air stream, such vent tubes 31 open at the top appear not to operate satisfactorily and for this reason, in accordance with a further aspect of the invention, such a vent tube is provided at the top with a prolongation 32 at right angles to the tube, as is shown in FIG. 5. The end of the prolongation 32 remote from the vent tube 31 is chamfered at an angle of preferably 45° so that the top side of the vent is longer than the lower side of the vent tube, as will be apparent from FIG. 5.

I claim:

1. A gas carburettor adapted for mounting on the petrol carburettor of a combustion engine for mixing gas with air and for supplying the mixture of air and gas to the combustion engine, said gas carburettor comprising a housing defining an annular gas supply channel having a substantially vertical wall portion bounding a central passage and having an opening therein for supplying the gas to the passage and an upper substantially horizontal wall portion joining said substantially vertical wall portion near its upper edge, and a member disposed in the passage partly closing the passage and having wall portions extending substantially parallel to said substantially vertical and substantially horizontal wall portions of said gas supply channel and spaced therefrom to define wall portions of said gas supply channel and spaced therefrom to define a gap between said channel and said member for supplying air from the environment to said passage.

2. A gas carburettor as claimed in claim 1 wherein a plurality of openings are provided in the periphery of the housing wall bounding the passage.

3. A gas carburettor as claimed in claim 1 or 2 wherein an opening in the housing wall bounding the passage is formed by an elongated slot.

4. A gas carburettor as claimed in claim 3 wherein a plurality of aligned, elongated slots extending concentrically about the centre line of the passage are provided so as to cover substantially the whole circumference of the housing wall bounding said passage.

5. A gas carburettor as claimed in claim 3 wherein viewed in the direction of movement of the air through the gap during operation, the cross-section of the gap gradually decreases and the lower side of the gap is located near the opening for the supply of gas.

6. A gas carburettor as claimed in claim 3 mounted on a petrol carburettor provided with at least one vent tube for the float chamber wherein the top end of the vent tube is bent over and extends transversely of the main direction of the air stream through the carburettors.

7. A gas carburettor as claimed in claim 6 wherein the top side of the bent-over end of the vent tube is longer than its lower side.

* * * * *